US006783206B2

(12) United States Patent
Bruhn et al.

(10) Patent No.: US 6,783,206 B2
(45) Date of Patent: Aug. 31, 2004

(54) VACUUM PLATEN ASSEMBLY FOR FLUID-EJECTION DEVICE WITH ANTI-CLOG VACUUM HOLE SIDEWALL PROFILES

(75) Inventors: Victor Bruhn, Vancouver, WA (US); Vance Stephens, Brush Prairie, WA (US); Jim Beehler, Brush Prairie, WA (US); Robert M. Yraceburu, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 54 days.

(21) Appl. No.: 10/295,142

(22) Filed: Nov. 15, 2002

(65) Prior Publication Data

US 2004/0095418 A1 May 20, 2004

(51) Int. Cl.[7] ..... B41J 2/165

(52) U.S. Cl. ..... 347/34; 347/104

(58) Field of Search ..... 347/22, 29–35, 347/104; 400/648

(56) References Cited

U.S. PATENT DOCUMENTS 4,463,361 A * 7/1984 Koumura et al. ..... 346/134
5,124,728 A * 6/1992 Denda ..... 346/134
5,291,227 A * 3/1994 Suzuki ..... 347/104
5,717,446 A * 2/1998 Teumer et al. ..... 347/35

FOREIGN PATENT DOCUMENTS

GB 2 359 277 8/2001 ..... B41J/29/17

* cited by examiner

*Primary Examiner*—Shih-Wen Hsieh

(57) ABSTRACT

A vacuum platen assembly for a fluid-ejection device of one embodiment of the invention is disclosed includes a platen that has a number of vacuum holes. Each of at least one of the vacuum holes has sidewalls with anti-clog profiles at least substantially prevent collection of media debris and aerosol on the sidewalls.

50 Claims, 4 Drawing Sheets

VACUUM PLATEN ASSEMBLY FOR FLUID-EJECTION DEVICE WITH ANTI-CLOG VACUUM HOLE SIDEWALL PROFILES

BACKGROUND OF THE INVENTION

Inkjet printers have become popular for printing on media, especially when precise printing of color images is needed. For instance, such printers have become popular for printing color image files generated using digital cameras, for printing color copies of business presentations, and so on. An inkjet printer is more generically a fluid-ejection device that ejects fluid, such as ink, onto media, such as paper.

To maintain positioning of the media while fluid is being ejected onto the media, some fluid-ejection devices utilize a vacuum effect to keep the media properly in place. For example, a number of vacuum holes, fluidly coupled with a vacuum source such as a centrifugal blower, can provide this vacuum effect. However, the vacuum-induced flow may also pull in media debris dislodged from the media, dust particles in the air, as well as aerosol, which includes fluid particles generated when the fluid is ejected. The media debris and aerosol can collect on the sidewalls of the vacuum holes, reducing the flow area they provide, and thus reducing vacuum capacity and the ability to maintain positioning of the media.

SUMMARY OF THE INVENTION

A vacuum platen assembly for a fluid-ejection device of one embodiment of the invention includes a platen that has a number of vacuum holes. Each of at least one of the vacuum holes has sidewalls with anti-clog profiles to at least substantially prevent collection of media debris and aerosol on the sidewalls.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
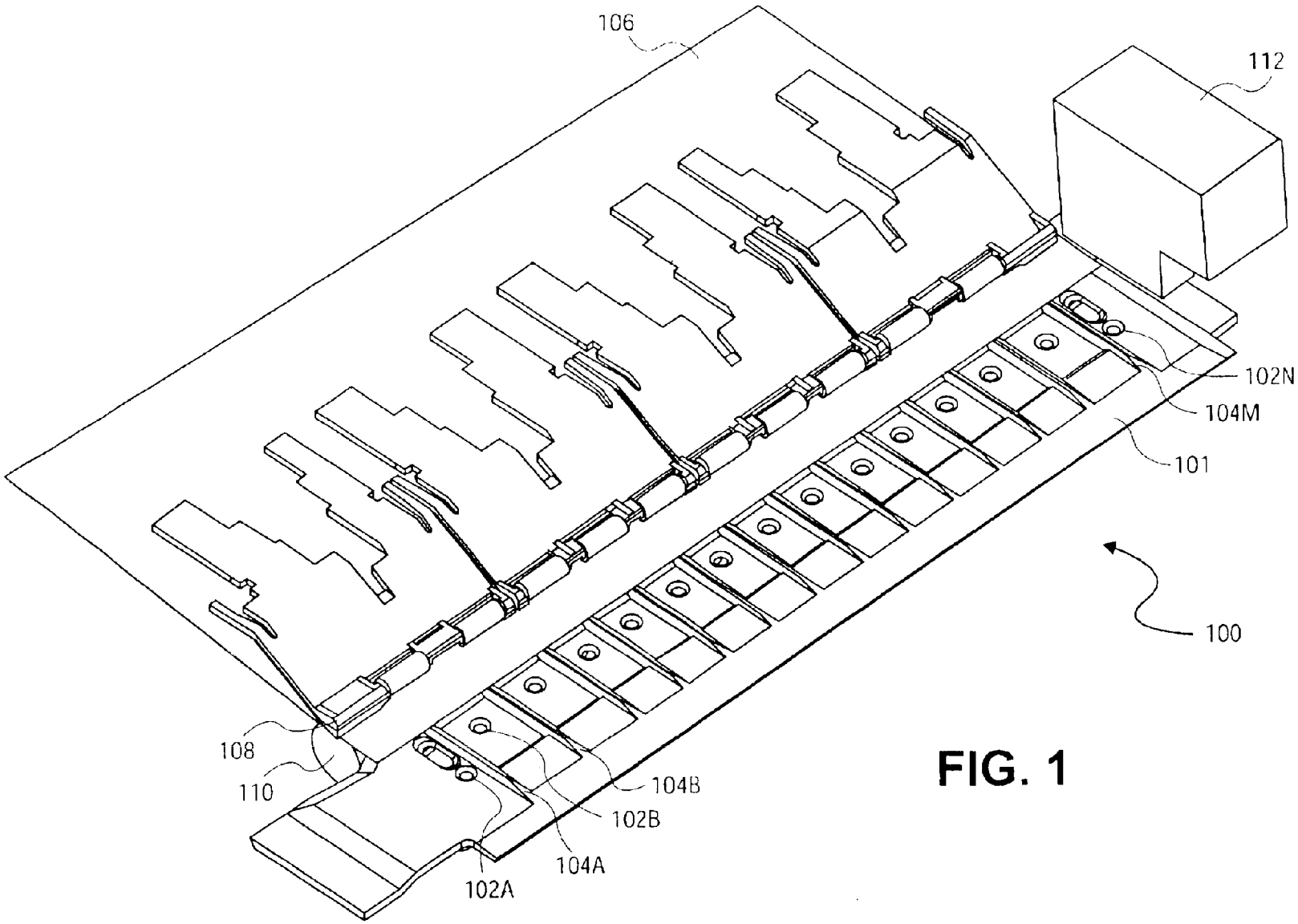
FIG. 1 is a diagram of a representative vacuum platen assembly of a fluid-ejection device, according to an embodiment of the invention.

FIG. 1 shows a representative vacuum platen assembly 100 for a fluid-ejection device, according to an embodiment of the invention. As can be appreciated by those of ordinary skill within the art, other types of vacuum platen assemblies, besides the assembly 100 of FIG. 1, may be utilized in conjunction with embodiments of the invention. The fluid-ejection device may be, for instance, a black-and-white and/or color inkjet printer for outputting ink onto media, such as paper. More generally, the fluid-ejection device outputs fluid onto media.

The vacuum platen assembly 100 includes a vacuum platen 101. As shown in FIG. 1, the vacuum platen 101 is positioned against a drive roller 110, over which a pinch roller 108 is positioned. Media 106 is fed through the drive roller 110 and the pinch roller 108 by forced rotation of the drive roller 110. As the media 106 then moves over the vacuum platen 101, a fluid-ejecting mechanism 112, such as a fluid-ejecting head like an inkjet printhead, moves back and forth over the media 106, ejecting fluid onto the media 106, which may be paper.

The vacuum platen assembly 100 includes a number of ribs 104A, 104B, . . . , 104M, collectively referred to as the ribs 104, that extend from the vacuum platen 101. The vacuum platen assembly 100 also includes a number of vacuum holes 102A, 102B, . . . , 102N, collective referred to as the vacuum holes 102. There may be more or less of the vacuum holes 102 as compared to the ribs 104. The vacuum holes 102 can extend completely through the vacuum platen 101, and provide a fluid connection with an external vacuum source, such as a centrifugal blower. The vacuum holes 102 alternatively can extend only partially through the vacuum platen 101.

As the media 106 is fed between the pinch roller 108 and the drive roller 110, it passes over the vacuum platen 101. To maintain positioning of the media 106 against the ribs 104, the vacuum or suction effect provided by the external vacuum source, transmitted via vacuum holes 102, suctions the media 106 against the ribs 104. The fluid-ejecting mechanism 112 then moves back and forth over the media 106 to eject fluid onto the media 106. Preferably, one of the ribs 104 is situated between every successively rolling pair of the holes 102. For example, the rib 104A is situated between the holes 102A and 102B.

Ejection of the fluid by the fluid-ejecting mechanism 112 can result in fluid aerosol, which includes very small airborne particles of fluid. Furthermore, movement of the media 106 can result in media debris becoming dislodged from the media 106. The aerosol and the media debris may be carried by vacuum airflow towards the vacuum holes 102. Although some of the aerosol and the media debris may be suctioned through the holes 102, other of the aerosol and the media debris may collect on the sidewalls of the holes 102, creating a blockage of air flow and inhibiting vacuum performance, or suction ability. Other types of debris that may collect on the sidewalls of the holes 102 include dust particles.

Figure 2:
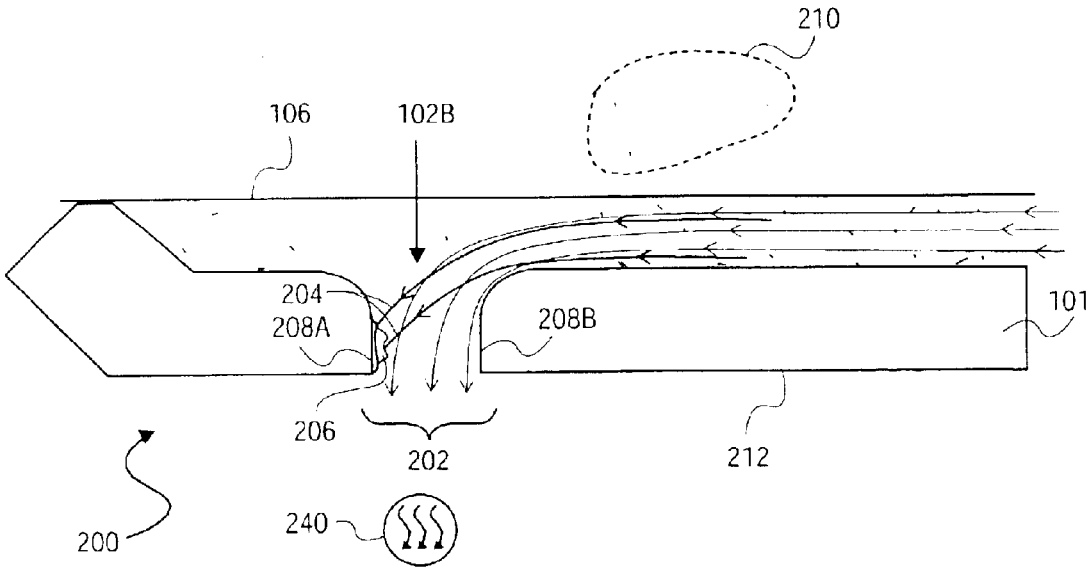
FIG. 2 is a diagram of a side profile of the vacuum platen assembly of FIG. 1 in more detail that shows the undesirable aerosol, dust particle, and media debris collection substantially prevented by embodiments of the invention.

FIG. 2 shows a scenario 200 that depicts the collection of aerosol, dust particles, and media debris on the sidewalls of vacuum holes, which is at least substantially prevented by embodiments of the invention. A side profile of a portion of the vacuum platen 101 is shown in detail, including the vacuum hole 102B. The vacuum hole 102B has sidewalls 208A and 208B, collectively referred to as the sidewalls 208, that are parallel to one another and at right angles to the lower surface 212 of the vacuum platen 101. The media 106 moves from left to right across FIG. 2.

Dust particles, fluid aerosol, and media debris are depicted in FIG. 2 by solid dots, such as the dots included within the dotted area 210. The fluid aerosol and media debris may become suctioned towards the vacuum hole 102B. The paths that air flow, aerosol, and debris so follow in their movement towards the hole 102B are represented by the arrows 202 and 204. The arrows 202 represent the motion of vacuum-induced air flow generated by an external vacuum source, represented by the blower symbol 240, such as a centrifugal blower.

Conversely, the arrows 204 represent the motion of those aerosol and debris particles which cannot fully make the turn into and thus cannot be suctioned through the vacuum hole 102B. Rather, such aerosol and debris collides with and collects on the sidewall 208A of the hole 102B, resulting in the collection of fluid aerosol and media debris 206. The collection of aerosol and debris 206 may build up on the sidewalls 208 over time, resulting in a clogging effect and reducing vacuum flow through the hole 102B.

Figure 3:
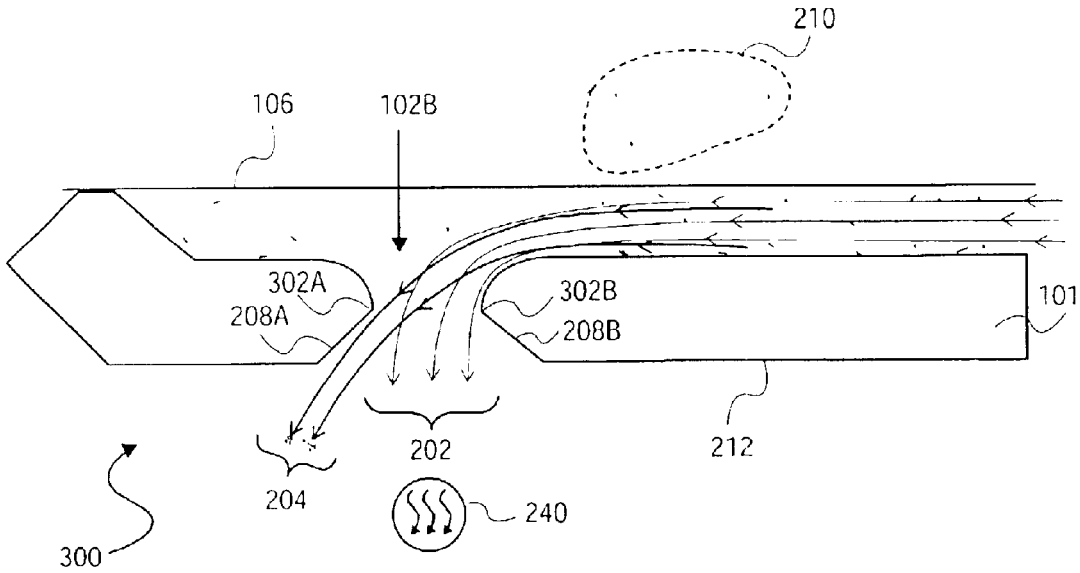
FIG. 3 is a diagram of a side profile of the vacuum platen assembly of FIG. 1 in more detail that shows how the profiles of the sidewalls of a vacuum hole substantially prevent aerosol, dust particle, and media debris collection, according to an embodiment of the invention.

FIG. 3 shows a scenario 300 that depicts the at least substantial prevention of the collection of dust particles, aerosol, and media debris on the sidewalls of vacuum holes, according to an embodiment of the invention. A side profile of a portion of the vacuum platen 101 is shown in detail, including the vacuum hole 102B. The vacuum hole 102B again has sidewalls 208A and 208B, collectively referred to as the sidewalls 208.

However, the sidewalls 208 are non-straight and non-parallel sidewalls that taper away from one another, and that are not at right angles to the lower surface 212 of the vacuum platen 101. They are non-straight because each sidewall has at least one point where internal surfaces thereof meet. The sidewall 208A has its internal surfaces meet at the point 302A, whereas the sidewall 208B has its internal surfaces meet at the point 302B. The sidewalls 208 are non-parallel because none of their internal surfaces are parallel to one another. Furthermore, the sidewalls 208 can be formed by backside-countersinking the vacuum hole 102B. That is, the sidewalls 208 can be formed by countersinking the vacuum hole 102B at the lower surface 212 of the platen 101. The media 106 moves from left to right across FIG. 3.

Dust particles, fluid aerosol, and media debris are again depicted in FIG. 3 by solid dots, such as the dots included within the dotted area 210. The dust particles, fluid aerosol, and media debris may become suctioned towards the vacuum hole 102B, in the direction of the arrows 202 or 204. The arrows 202 represent the motion of vacuum-induced air flow generated by an external vacuum source, represented by the blower symbol 240, such as a centrifugal blower.

However, unlike the scenario 200 of FIG. 2, in the scenario 300 of FIG. 3, the arrows 204 that represent the motion of aerosol and debris, which in the scenario 200 would have collected on the sidewalls 208 of hole 102B, are now suctioned through the vacuum hole 102B, and do not collide with and collect on the sidewall 208A of the hole 102B. This is because the profiles of the sidewalls 208 of the hole 102B are such that they are not in the path of aerosol and debris particle travel, and at least substantially prevent such collection of aerosol and debris on the sidewalls 208. That is, in the embodiment of FIG. 3, the tapering, non-parallel, and/or non-straight nature of the sidewalls 208 allow even the relatively fast moving aerosol and debris to travel through the hole 102B. The profiles of the sidewalls 208 thus at least substantially prevent reduction, or impairment, of the vacuum-induced airflow through the vacuum hole 102B that may otherwise result if the aerosol and debris were to collect on either of the sidewalls 208.

Figure 4:
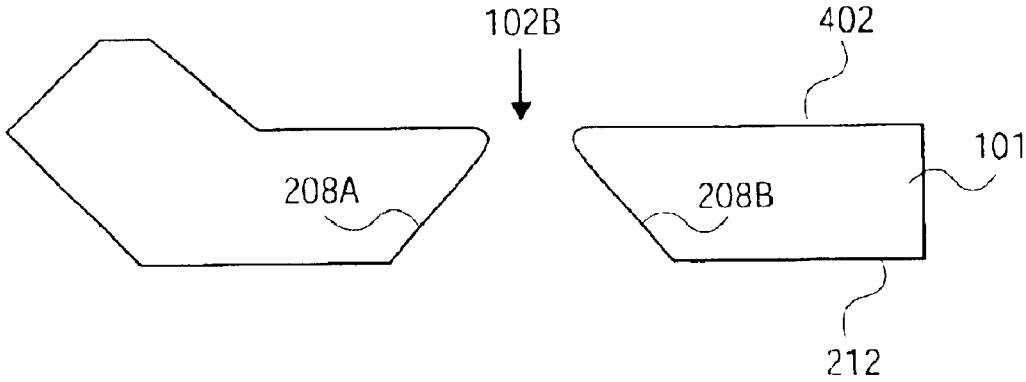
FIGS. 4 and 5 are diagrams of other profiles of the sidewalls of a vacuum hole of a vacuum platen assembly that substantially prevent aerosol, dust particle, and media debris collection, according to varying embodiments of the invention.
Figure 5:
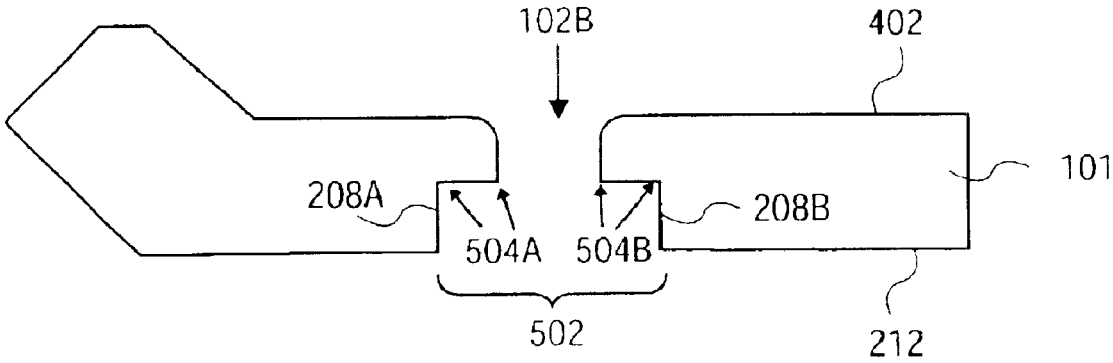

Therefore, most generally, the profiles of the sidewalls 208 of the vacuum hole 102B are configured so that the collection of media debris and aerosol on the sidewalls 208 is at least substantially prevented. Sidewall profiles other than that depicted in FIG. 3, however, can be used to achieve this same effect. Two such alternative profiles are depicted in FIGS. 4 and 5. Those of ordinary skill within the art can appreciate that embodiments of the invention are not limited to the sidewall profiles depicted in FIGS. 3, 4, or 5, however.

FIG. 4 shows an embodiment of the invention in which the sidewalls 208 of the vacuum hole 102B are tapered, such that the opening of the hole 102B at the upper surface 402 of the vacuum platen 101 is smaller than the opening of the hole 102B at the lower surface 212 of the platen 101. The sidewalls 208 in the embodiment of FIG. 4 are thus non-parallel, like the sidewalls 208 in the embodiment of FIG. 3, but not non-straight, unlike the sidewalls 208 in the embodiment of FIG. 3. The sidewalls 208 in the embodiment of FIG. 4 are not non-straight because they do not have internal surfaces that meet at one or more points, unlike the sidewalls 208 in the embodiment of FIG. 3.

FIG. 5 shows an embodiment of the invention in which the sidewalls 208 of the vacuum hole 102B are formed by a backside counter-bore 502, from the lower surface 212 of the vacuum platen 101, such that the opening of the hole 102B at the upper surface 402 of the platen 101 is smaller than the opening at the lower surface 212. The sidewalls 208 in the embodiment of FIG. 5 thus result from backside counter-boring of the hole 102B, like the sidewalls 208 in the embodiment of FIG. 3 do, but are not non-parallel, unlike the sidewalls 208 in the embodiments of FIGS. 3 and 4.

The sidewalls 208 in the embodiment of FIG. 5 are non-straight and non-parallel, however. The sidewalls 208 in the embodiment of FIG. 5 are non-straight because they have internal surfaces that meet at one or more points. For instance, the internal surfaces of the sidewall 208A meet at the points 504A, whereas the internal surfaces of the sidewall 208B meet at the points 504B.

The vacuum hole 102B has been shown in and described in conjunction with FIGS. 3, 4, and 5 as a representative hole of the vacuum holes 102 of the vacuum platen assembly 100 of FIG. 1. As can be appreciated by those of ordinary skill within the art, other and/or additional of the vacuum holes 102 of the platen assembly 100 may have sidewall profiles as depicted in FIGS. 3, 4, and 5. For instance, in one embodiment, all of the vacuum holes 102 of the assembly 100 may have the same sidewall profile as that depicted in FIG. 3, 4, or 5.

Figure 6:
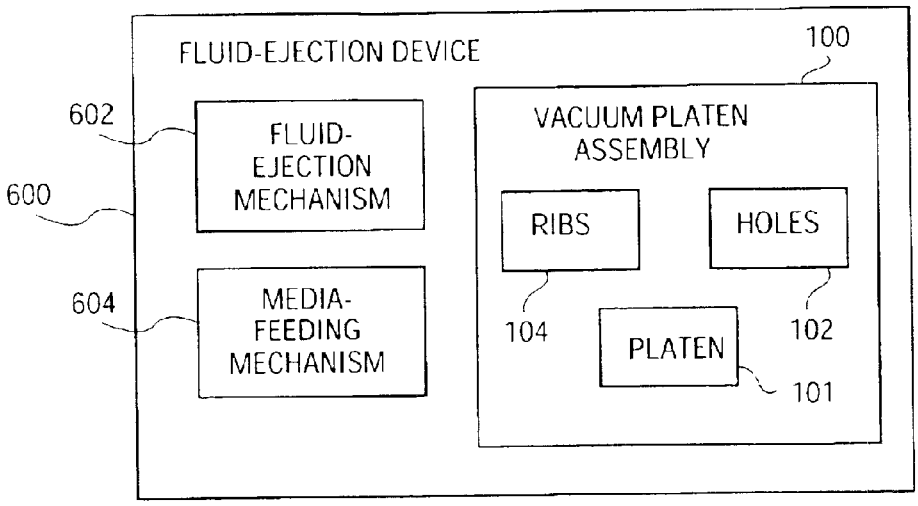
FIG. 6 is a block diagram of a fluid-ejection device, according to an embodiment of the invention.

FIG. 6 shows a block diagram of a representative fluid-ejection device 600, according to an embodiment of the invention. The fluid-ejection device 600 may be an inkjet printer, or another type of fluid ejection device. The fluid-ejection device 600 includes a fluid-ejection mechanism 602, a media-feeding mechanism 604, and the vacuum platen assembly 100, a particular embodiment of which is depicted in FIG. 1.

The fluid-ejection mechanism 602 ejects fluid onto media, such as ink onto media like paper. The mechanism 602 may be an inkjet-printing mechanism. The mechanism 602 may include a fluid-ejecting head, such as a fluid-ejecting head like an inkjet printhead. The media-feeding mechanism 604 feeds media for ejection of fluid thereon by the fluid-ejecting mechanism 602. In one embodiment, the mechanism 604 includes the rollers 108 and/or 110 of FIG. 1.

The vacuum platen assembly 100 is specifically depicted in FIG. 6 as including ribs 104, vacuum holes 102, and the platen 101. The vacuum holes 102 have sidewalls that have profiles to substantially prevent collection of dust particles, media debris, and aerosol thereon. For instance, the vacuum holes 102 may be that as has been shown in and described in conjunction with FIG. 3, 4, or 5. As has also been described, the ribs 104 extend from the platen 101, and the vacuum holes 102 transmit vacuum from the external vacuum source to maintain positioning of media against the ribs 104.

Figure 7:
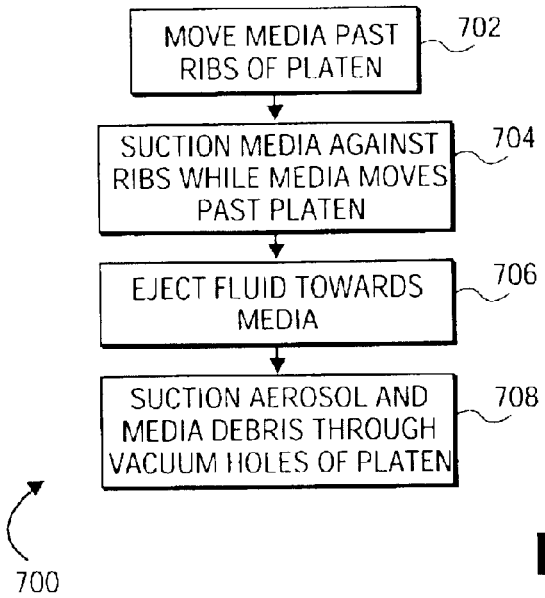
FIG. 7 is a flowchart of a method, according to an embodiment of the invention.

FIG. 7 shows a method 700, according to an embodiment of the invention. The method 700 can be utilized in conjunction with the vacuum platen assembly 100 of FIG. 1, the vacuum hole sidewall profiles of FIG. 3, 4, or 5, and/or the fluid-ejection device 600 of FIG. 6. First, media is moved past ribs that extend from a vacuum platen (702), which can result in media debris being dislodged from the media. As the media moves past the platen, the media is suctioned against the ribs (704), due to the suction effect of the external vacuum source transmitted by the vacuum holes within the platen. Fluid is then ejected towards the media (706), which can result in aerosol. The aerosol and the debris are at least substantially suctioned through the vacuum holes of the platen (708), because the sidewalls of the holes have profiles as have been shown in and described in conjunction with FIG. 3, 4, or 5. For instance, the sidewalls may be non-parallel to one another.

Figure 8:
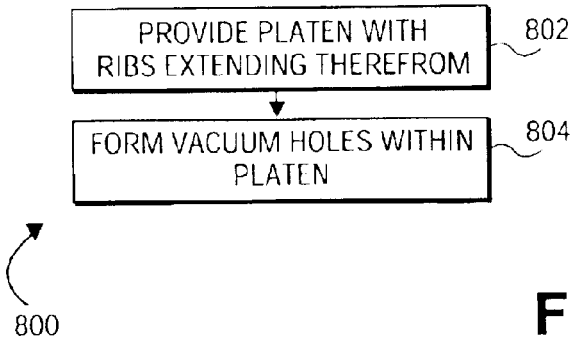
FIG. 8 is a flowchart of a method for manufacturing a vacuum platen assembly, according to an embodiment of the invention.

FIG. 8 shows a method 800 for manufacturing a vacuum platen assembly, according to an embodiment of the invention. The method 800 can be utilized to manufacture the vacuum platen assembly 100 of FIG. 1, the vacuum holes of which have sidewall profiles of FIG. 3, 4, or 5. A platen is provided that has ribs extending therefrom (802). Vacuum holes are then formed within the platen (804). The vacuum holes at least substantially prevent the collection of debris on their sidewalls, due to the sidewalls having profiles as have been shown in and described in conjunction with FIG. 3, 4, or 5. For instance, the sidewalls may be non-parallel to one another. It is noted that the platen with the ribs and the vacuum holes may be provided at the same time, such as via a single injection-molding operation.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A vacuum platen assembly for a fluid-ejection device comprising:

a platen having a plurality of vacuum holes, each of at least one of the plurality of vacuum holes having sidewalls with anti-clog profiles to at least substantially prevent collection of media debris and aerosol on the sidewalls.

2. The vacuum platen assembly of claim 1, further comprising a vacuum source fluidly coupled to the plurality of vacuum holes of the platen.

3. The vacuum platen assembly of claim 1, wherein the anti-clog profiles of the sidewalls further at least substantially prevent collection of dust particles on the sidewalls.

4. The vacuum platen assembly of claim 1, wherein the sidewalls of each of the at least one of the plurality of vacuum holes are non-parallel sidewalls.

5. The vacuum platen assembly of claim 1, wherein the sidewalls of each of the at least one of the plurality of vacuum holes are non-straight sidewalls.

6. The vacuum platen assembly of claim 1, wherein the sidewalls of each of the at least one of the plurality of vacuum holes are tapering sidewalls.

7. The vacuum platen assembly of claim 1, wherein each of the at least one of the plurality of vacuum holes has a backside countersink defining the profiles of the sidewalls of the hole.

8. The vacuum platen assembly of claim 1, wherein the profiles of each of the at least one of the plurality of vacuum holes at least substantially prevent reduction of suction effect of the hole.

9. The vacuum platen assembly of claim 1, wherein the plurality of vacuum holes are situated within the platen.

10. The vacuum platen assembly of claim 1, wherein the plurality of vacuum holes are situated through the platen.

11. The vacuum platen assembly of claim 1, wherein the at least one of the plurality of vacuum holes represents all of the plurality of vacuum holes.

12. The vacuum platen assembly of claim 1, further comprising a plurality of ribs extending from the platen, against which positioning of media is maintained during operation by suction effect from the plurality of vacuum holes.

13. The vacuum platen assembly of claim 1, wherein the fluid-ejection device is an inkjet printer.

14. A vacuum platen assembly for a fluid-ejection device comprising:

a platen having a plurality of vacuum holes, each of at least one of the plurality of vacuum holes having non-parallel sidewalls; and, a plurality of ribs extending from the platen, against which positioning of media is maintained during operation by suction effect from the plurality of vacuum holes.

15. The vacuum platen assembly of claim 14, wherein the non-parallel sidewalls of each of the at least one of the plurality of vacuum holes at least substantially prevent collection of dust particles, media debris, and aerosol on the sidewalls of the hole so as to at least substantially prevent reduction of the suction effect of the hole.

16. The vacuum platen assembly of claim 14, wherein the non-parallel sidewalls of each of the at least one of the plurality of vacuum holes are at least one of: non-straight sidewalls and tapering sidewalls.

17. The vacuum platen assembly of claim 14, wherein the non-parallel sidewalls of each of the at least one of the plurality of vacuum holes result from a backside countersink of the hole.

18. The vacuum platen assembly of claim 14, wherein the plurality of ribs extend from the platen between every successively rolling vacuum hole pair of the plurality of vacuum holes.

19. The vacuum platen assembly of claim 14, wherein the suction effect of the plurality of holes is provided by a vacuum source fluidly coupled to the plurality of holes.

20. The vacuum platen assembly of claim 14, wherein the fluid-ejection device is an inkjet printer.

21. A vacuum platen assembly for a fluid-ejection device comprising:

a platen;

a plurality of ribs extending from the platen; and, means for providing suction effect to maintain positioning of media against the plurality of ribs by suction effect substantially without suction-impairing collection of at least one of: dust particles, media debris, and aerosol.

22. The vacuum platen assembly of claim 21, wherein the means comprises at least one vacuum hole, each having at least one: of non-parallel sidewalls, non-straight sidewalls, and tapering sidewalls.

23. The vacuum platen assembly of claim 21, wherein the means comprises at least one vacuum hole, each having a backside countersink.

24. The vacuum platen assembly of claim 21, wherein the fluid-ejection device is an inkjet printer.

25. A fluid-ejection device comprising:

a fluid-ejection mechanism ejecting fluid towards media, ejection of the fluid resulting in dispersal of aerosol;

a vacuum platen having a plurality of vacuum holes; and, a plurality of ribs extending from the vacuum platen, against which positioning of the media is maintained during operation by suction effect from the plurality of vacuum holes, while the media moves over the vacuum platen, resulting in media debris, each of at least one of the plurality of vacuum holes having sidewalls with profiles at least substantially prevent collection of the media debris and the aerosol on the sidewalls.

26. The fluid-ejection device of claim 25, wherein the sidewalls of each of the at least one of the plurality of vacuum holes are at least one of: non-parallel sidewalls, non-straight sidewalls, and tapering sidewalls.

27. The fluid-ejection device of claim 25, wherein each of the at least one of the plurality of vacuum holes has a backside countersink defining the profiles of the sidewalls of the hole.

28. The fluid-ejection device of claim 25, wherein the profiles of the sidewalls of each of the at least one of the plurality of vacuum holes to at least substantially prevent reduction of the suction effect of the hole.

29. The fluid-ejection device of claim 25, wherein the plurality of ribs extend from the vacuum platen between every successively rolling vacuum hole pair of the plurality of vacuum holes.

30. The fluid-ejection device of claim 25, wherein the suction effect of the plurality of holes is provided by a vacuum source fluidly coupled to the plurality of holes.

31. The fluid-ejection device of claim 25, wherein the fluid-ejection device is an inkjet printer, the fluid-ejection mechanism is an inkjet-printing mechanism, and the fluid is ink.

32. A method comprising:

moving media past a plurality of ribs of a platen, resulting in media debris;

suctioning media against the plurality of ribs while the media moves past the platen, utilizing a plurality of vacuum holes through the platen, each hole having non-parallel sidewalls; and, ejecting fluid towards the media, resulting in dispersal of aerosol.

33. The method of claim 32, further comprising suctioning the aerosol and the media debris through the plurality of vacuum holes of the platen without substantial suction effect-impairing collection of the aerosol and the media debris on the sidewalls of any hole.

34. The method of claim 32, wherein the non-parallel sidewalls of each of the plurality of vacuum holes are at least one of: non-straight sidewalls and tapering sidewalls.

35. The method of claim 32, wherein the non-parallel sidewalls of each of the plurality of vacuum holes resulting from a backside countersink of the hole.

36. The method of claim 32, wherein the platen is part of a fluid-ejection device.

37. The method of claim 36, wherein the fluid is ink.

38. A method comprising:

providing a platen having a plurality of ribs extending therefrom; and, forming a plurality of vacuum holes within the platen, each hole having non-parallel sidewalls.

39. The method of claim 38, wherein forming the plurality of vacuum holes within the platen comprises forming the plurality of vacuum holes within the platen, the non-parallel sidewalls of each hole being one of: non-straight sidewalk and tapering sidewalls.

40. The method of claim 38, wherein forming the plurality of vacuum holes within the platen comprises backside-countersinking each of the plurality of vacuum holes to result in the non-parallel sidewalls of each hole.

41. The method of claim 38, wherein forming the plurality of vacuum holes within the platen comprises forming a vacuum hole between each successively rolling rib pair of the plurality of ribs, between a first rib of the plurality of ribs and a first end of the platen, and between a last rib of the plurality of ribs and a last end of the platen.

42. The method of claim 38, wherein forming the plurality of vacuum holes within the platen comprises forming the plurality of vacuum holes through the platen.

43. The method of claim 38, wherein providing the platen comprises providing a vacuum platen of a fluid-ejection device.

44. The method of claim 38, wherein providing the platen comprises providing a vacuum platen of an inkjet printer.

45. A vacuum platen assembly for a fluid-ejection device comprising:

a platen having a plurality of vacuum holes, each of at least one of the plurality of vacuum holes having sidewalls with anti-clog profiles to at least substantially prevent collection of media debris and aerosol on the sidewalls, wherein the sidewalls of each of the at least one of the plurality of vacuum holes are one or more of: non-parallel sidewalls, non-straight sidewalk, and tapering sidewalls.

46. The vacuum platen assembly of claim 45, further comprising a vacuum source fluidly coupled to the plurality of vacuum holes of the platen.

47. The vacuum platen assembly of claim 45, wherein the anti-clog profiles of the sidewalls further at least substantially prevent collection of dust particles on the sidewalls.

48. The vacuum platen assembly of claim 45, wherein the profiles of each of the at least one of the plurality of vacuum holes at least substantially prevent reduction of suction effect of the hole.

49. A vacuum platen assembly for a fluid-ejection device comprising:

a platen having a plurality of vacuum holes, each of at least one of the plurality of vacuum holes having sidewalls with anti-clog profiles to at least substantially prevent collection of media debris and aerosol on the sidewalls, wherein each of the at least one of the plurality of vacuum holes has a backside countersink defining the profiles of the sidewalls of the hole.

50. The vacuum platen assembly of claim 49, further comprising a vacuum source fluidly coupled to the plurality of vacuum holes of the platen.

* * * * *

UNITED STATES PATENT AND TRADEMARK OFFICE

CERTIFICATE OF CORRECTION

PATENT NO. : 6,783,206 B2
DATED : August 31, 2004
INVENTOR(S) : Victor Bruhn et al.

It is certified that error appears in the above-identified patent and that said Letters Patent is hereby corrected as shown below:

Column 8,
Lines 27 and 57, delete "sidewalk" and insert -- sidewalls --

Signed and Sealed this

Nineteenth Day of April, 2005

JON W. DUDAS
*Director of the United States Patent and Trademark Office*